US007513074B2

(12) United States Patent
Glenn et al.

(10) Patent No.: US 7,513,074 B2
(45) Date of Patent: Apr. 7, 2009

(54) UNIVERSAL END CAP FOR RETAIL FIXTURES

(76) Inventors: Iris Glenn, 18507 Meadow La., Hazelcrest, IL (US) 60429; Susan Cohen, 223 Crabapple La., Valparaiso, IN (US) 46383

( * ) Notice: Subject to any disclaimer, the term of this patent is extended or adjusted under 35 U.S.C. 154(b) by 535 days.

(21) Appl. No.: 11/346,918

(22) Filed: Feb. 3, 2006

(65) Prior Publication Data

US 2007/0210499 A1 Sep. 13, 2007

(51) Int. Cl.
*G09F 3/20* (2006.01)

(52) U.S. Cl. ..... 40/649; 40/642.01; 40/661.05; 24/654; 24/656; 24/701

(58) Field of Classification Search ..... 40/642.01; 248/221.12, 222.41; 211/54.1, 57.1, 59.1; 403/353

See application file for complete search history.

(56) References Cited

U.S. PATENT DOCUMENTS

| | | | | |
|---|---|---|---|---|
| 559,567 | A | 5/1896 | Chamberlin | |
| 1,826,037 | A | 10/1931 | Allen | |
| 2,141,342 | A | 12/1938 | Brownell | |
| 2,288,071 | A | 6/1942 | Cohen | |
| 2,859,546 | A | 11/1958 | Gutterson | |
| 2,987,841 | A | 6/1961 | Phillips | |
| 4,292,749 | A | 10/1981 | Thomas | |
| 4,967,500 | A | 11/1990 | Bredeweg | |
| 5,174,537 | A | 12/1992 | Mazzorato | |
| 5,237,767 | A | 8/1993 | Kringel et al. | |
| 5,860,239 | A | 1/1999 | Thalenfeld et al. | |
| 6,006,463 | A | 12/1999 | Mueller | |
| 6,059,124 | A * | 5/2000 | Weck et al. | 211/57.1 |
| 6,128,843 | A | 10/2000 | Gebka | |
| 6,254,302 | B1 * | 7/2001 | Kraus | 403/326 |
| 6,289,826 | B1 * | 9/2001 | Waisbrod | 108/157.1 |
| 6,357,154 | B1 | 3/2002 | Pfendler et al. | |
| 7,413,371 | B2 * | 8/2008 | Arnold et al. | 403/353 |

* cited by examiner

*Primary Examiner*—Joanne Silbermann
(74) *Attorney, Agent, or Firm*—Trexler, Bushnell, Giangiorgi, Blackstone & Marr, Ltd.

(57) ABSTRACT

A universal end cap for displaying collateral on a fixture arm is described. The end cap is mounted on a fixture arm for displaying collateral and has a frame of a base, a lip protruding from the base, a channel in the lip, and a slot in the lip, whereby the collateral fits through the slot and is engaged by the channel; an attachment section coupled to the frame and having a wall projecting from the frame and a head section and a pair of jaw sections protruding inwards from the wall, the head section and the jaw sections defining a keyhole slot having a first slot defined by the jaw sections and a second slot defined by the head section and the jaw sections; and a ratchet securing an end cap key of the fixture arm within the keyhole slot, the ratchet being an framework mounted within guides on the frame and teeth located on the frame between the guides, the framework being a securing face, a latch, a finger mounted to the latch and protruding from the latch in a direction toward the frame, and a tab mounted to the latch and protruding from the latch in a direction away from the frame, the latch biased to engage the finger in the teeth and the tab operable to disengage the finger from the teeth.

5 Claims, 12 Drawing Sheets

UNIVERSAL END CAP FOR RETAIL FIXTURES

BACKGROUND OF THE INVENTION

This invention relates to the field of retail merchandising. Retail merchandise, and particularly clothing, is commonly displayed for sale on hangers. Some merchandise, such as shirts and jackets, is displayed on separate hangers. Other merchandise, such as socks, is attached to cardboard devices with apertures therein for hanging. The hangers are placed on horizontally-extending arms of various types of fixtures. Exemplary fixtures commonly used in retail merchandising include wall fixtures, 32-arm free-standing fixtures, and 16-arm free-standing fixtures. The fixtures are usually, but not always, metal, because they must hold a great amount of weight and are subject to both static and dynamic loads.

Collateral are visual pieces that draw the consumers' attention to the products, that identify the products, and that advertise special promotions. Special promotions are, by way of example and not by way of limitation, such offers as price reductions.

Consumer goods manufacturers, and especially manufacturers of clothing, have frequent promotional campaigns for their goods. For example, as part of a promotional campaign, field merchandisers employed by a clothing manufacturer will visit stores selling the manufacturer's clothes at retail, and place collateral on the goods that are subject to the promotional campaign. For example, a clothing manufacturer may offer a one-week special on shirts at 25 percent off the listed price. The field merchandisers go the retail stores and place collateral offering this special price reduction on all the shirts of that particular manufacturer that are being offered for sale.

Collateral is generally disposable and therefore usually made of heavy paper or cardboard. Collateral often consists of collar tags, which are placed on the hangers holding the promoted merchandise. Collar tag collateral is time-consuming (and therefore costly) to use, as a separate tag must be placed on every item. Furthermore, a consumer may remove an item of merchandise from the fixture arm for a closer look or to try it on, and in the process remove the collar tag. Consumers have little motivation to replace the collar tag on the hanger before returning the item to the fixture arm. Retail store employees are often similarly unmotivated. Field merchandisers report finding great quantities of collar tags scattered on the floors of retail stores and especially on the floors of fitting rooms of retail stores. Therefore, neither manufacturers, who pay for the collateral, nor retail stores, who must clean up the debris, prefer to use collar tags.

An alternative to collar tags is a collateral holder displayed at the end of a fixture arm. One method has been to have a separate arm to hold the collateral. For example, U.S. Pat. No. 5,860,239 to Thalenfeld, Merchandise Display Hook with Pivoting Label Holder, describes a label support that extends from the wall, above and parallel to the fixture arm. U.S. Pat. No. 6,006,463 to Mueller, Label Holder, similarly describes a body that extends from the wall, above and parallel to the fixture arm. These types of devices are bulky and usable only with certain types of fixtures.

Another alternative is for the arms of the fixtures to hold end caps, which are used to display collateral. End caps as known in the art are generally removable. A permanent end cap must always contain collateral, as an empty end cap presents a displeasing appearance to shoppers. Special promotions are not always in effect for all goods being sold, so collateral is not always available from the goods manufacturers and the retailers do not want to procure their own collateral. Accordingly, retailers do not want permanent end caps. Removable end caps, however, as are known in the art, are specific to specific fixtures. Different fixtures made by different manufacturers, or different models of fixtures from the same manufacturer, have different shapes.

Some exemplary types of fixture arms are shown in front perspective view in FIG. 1A and in rear perspective view in FIG. 1B. In these exemplary devices as used in the merchandising art, fixture arm 24 extends laterally from a wall or from fixture trunk (not shown) and terminating, at an end distal from the wall or trunk, in an end cap key 26. Some fixture arms 24 are generally round or polygonal, having a radially extending rib 28 at its end opposite the wall or trunk. Some fixture arms 24 are generally rectangular, having an upwardly extending strut 30. Merchandise hangs from fixture arm 24 for perusal by shoppers.

An end cap that fits one fixture arm will either not fit a different fixture arm at all, or will fit loosely. For example, an end cap designed to fit a fixture arm 24 with an outwardly extending rib 28 will not fit well on a fixture arm with an upwardly extending strut 26. A loose end cap is likely to be knocked off, which at a minimum removes the collateral therein from the view of shoppers.

Therefore, a particular retail establishment, which may own a number of different fixtures made by different fixture manufacturers, is required to maintain a supply of separate end caps for each type of fixture. Storing and keeping track of various end caps for different fixture arms, as a retail store changes its layouts at, for example, the beginning of a new season, is time consuming. There would be a commercial advantage in having a universal end cap that will fit almost any fixture arm.

Accordingly, there is a need for a universal, removable end cap to display collateral that will catch the eye of shoppers, to which collateral can be easily applied, and that will fit on various types of fixtures. The present invention meets this need.

SUMMARY OF THE INVENTION

The universal end cap of the present invention is mounted on a fixture arm for displaying collateral and has a frame of a base, a lip protruding from the base, a channel in the lip, and a slot in the lip, whereby the collateral fits through the slot and is engaged by the channel; an attachment section coupled to the frame and having a wall projecting from the frame and a head section and a pair of jaw sections protruding inwards from the wall, the head section and the jaw sections defining a keyhole slot having a first slot defined by the jaw sections and a second slot defined by the head section and the jaw sections; and a ratchet securing an end cap key of the fixture arm within the keyhole slot, the ratchet being an framework mounted within guides on the frame and teeth located on the frame between the guides, the framework being a securing face, a latch, a finger mounted to the latch and protruding from the latch in a direction toward the frame, and a tab mounted to the latch and protruding from the latch in a direction away from the frame, the latch biased to engage the finger in the teeth and the tab operable to disengage the finger from the teeth.

DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1A:
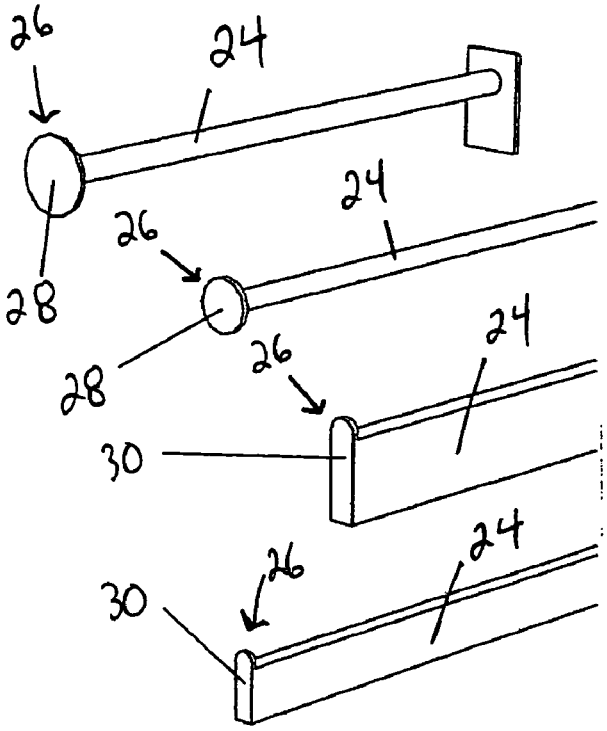
FIG. 1A is a front perspective view of several representative fixture arms to which the universal end cap of the present invention will adapt.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 1B:
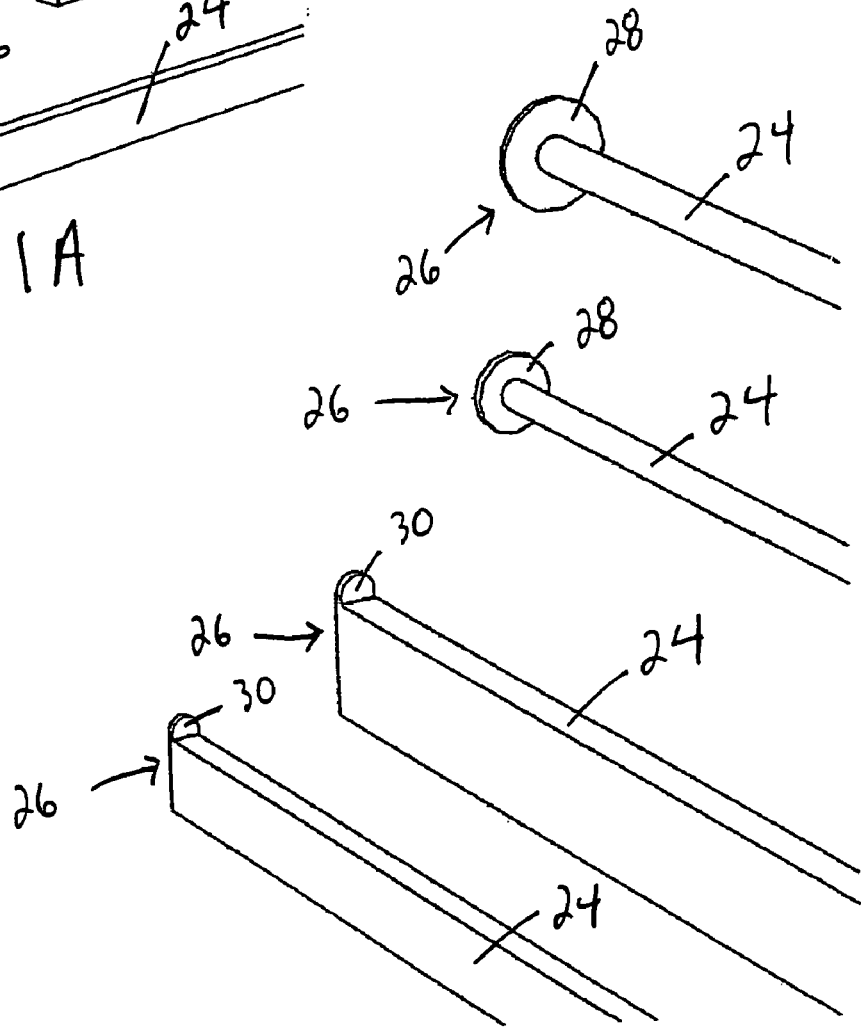
FIG. 1B is a rear perspective view of the fixture arms of FIG. 1A.
Figure 2:
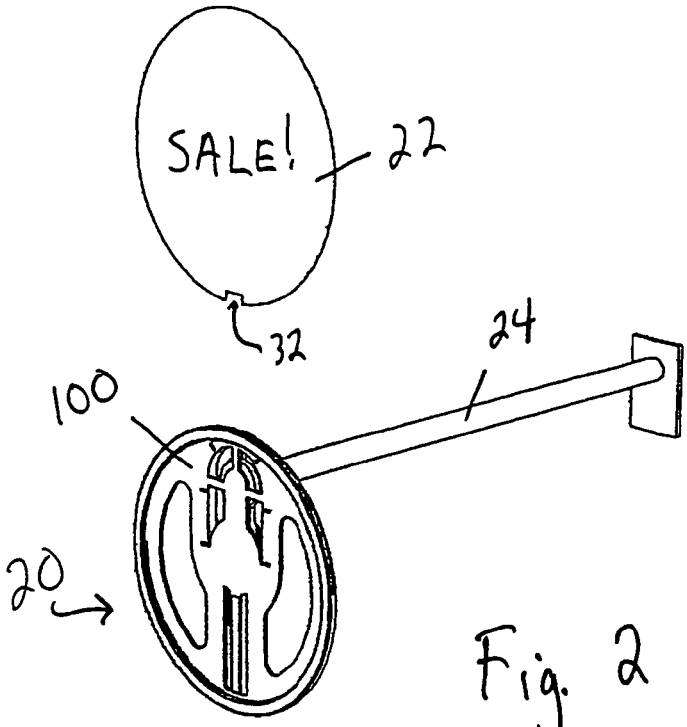
FIG. 2 is a front perspective view of a universal end cap of the preferred embodiment of the present invention, attached to a fixture arm, and an item of collateral.
Figure 3:
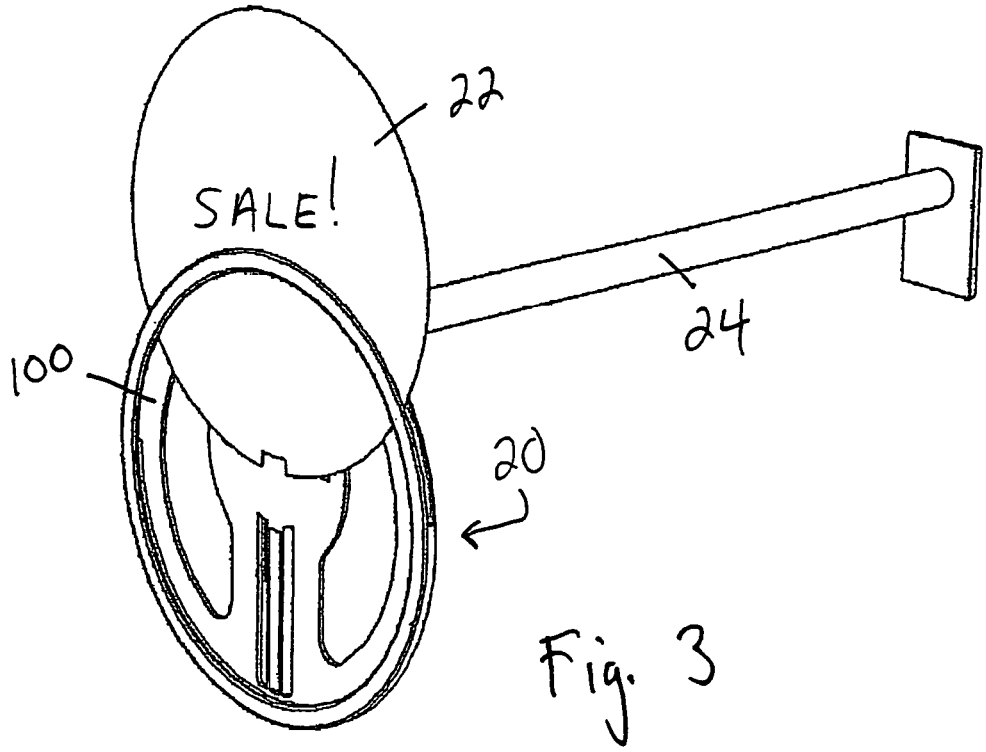
FIG. 3 is a front perspective view of the universal end cap and fixture arm of FIG. 2, with the collateral partially inserted in the frame.
Figure 4:
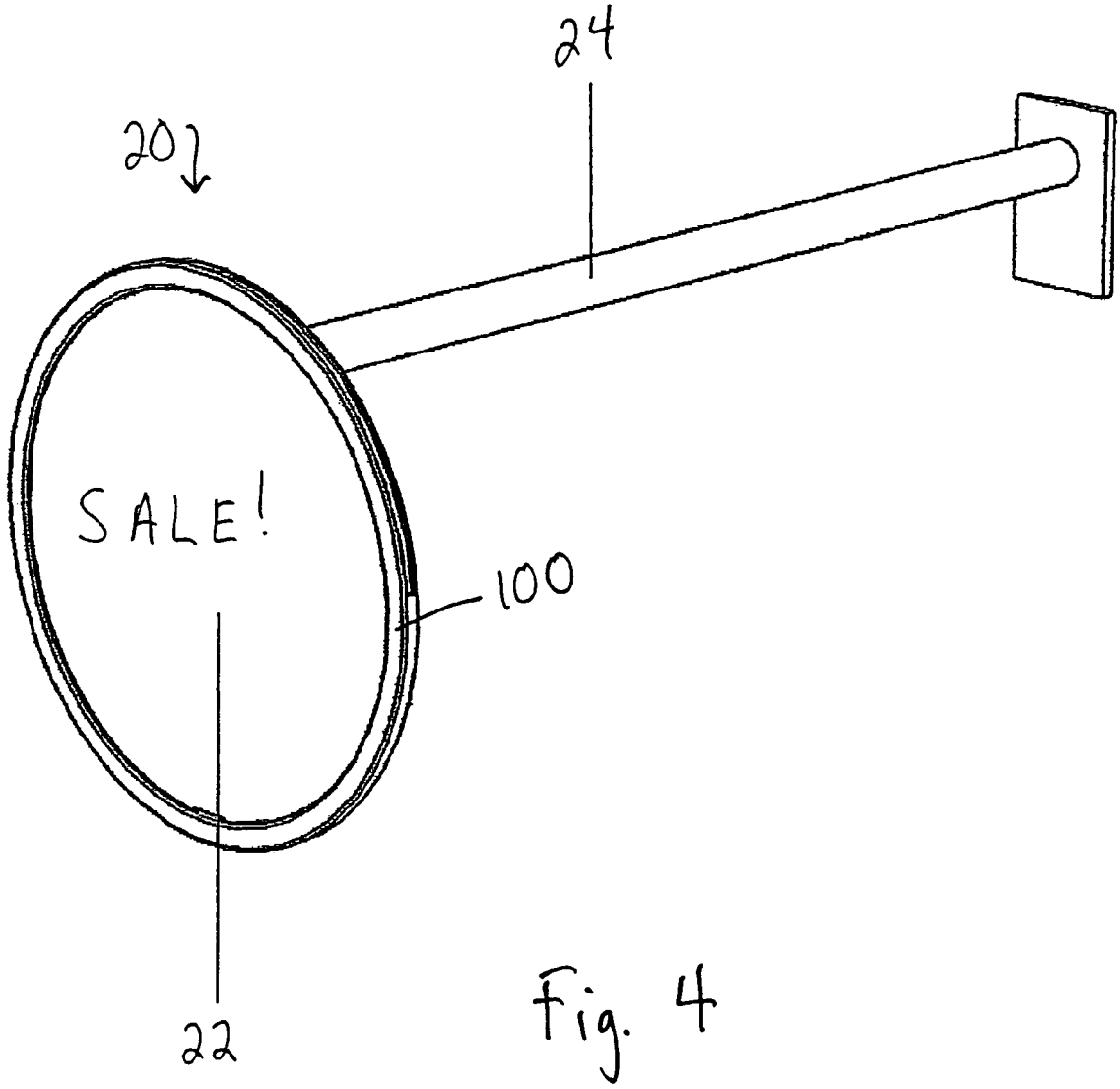
FIG. 4 is a front perspective view of the universal end cap and fixture arm of FIGS. 2 and 3, with the collateral completely inserted in the frame.

The end cap 20 of the preferred embodiment of the present invention, for holding collateral 22, is shown in front perspective views in FIGS. 2 through 4. FIG. 1 shows an end cap 20 attached to a fixture arm 24, ready to receive collateral 22; FIG. 3 shows the end cap 20 with collateral 22 partially placed therein; and FIG. 4 shows the end cap 20 with collateral 22 in place and displaying a sale.

Figure 5A:
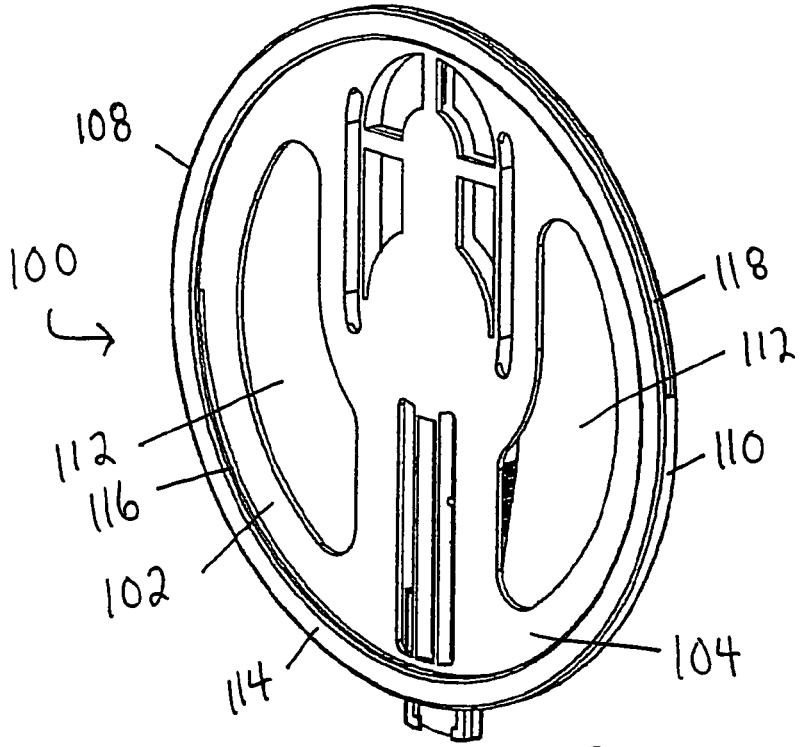
FIG. 5A is a front perspective view of the preferred embodiment of the universal end cap of the present invention.
Figure 5B:
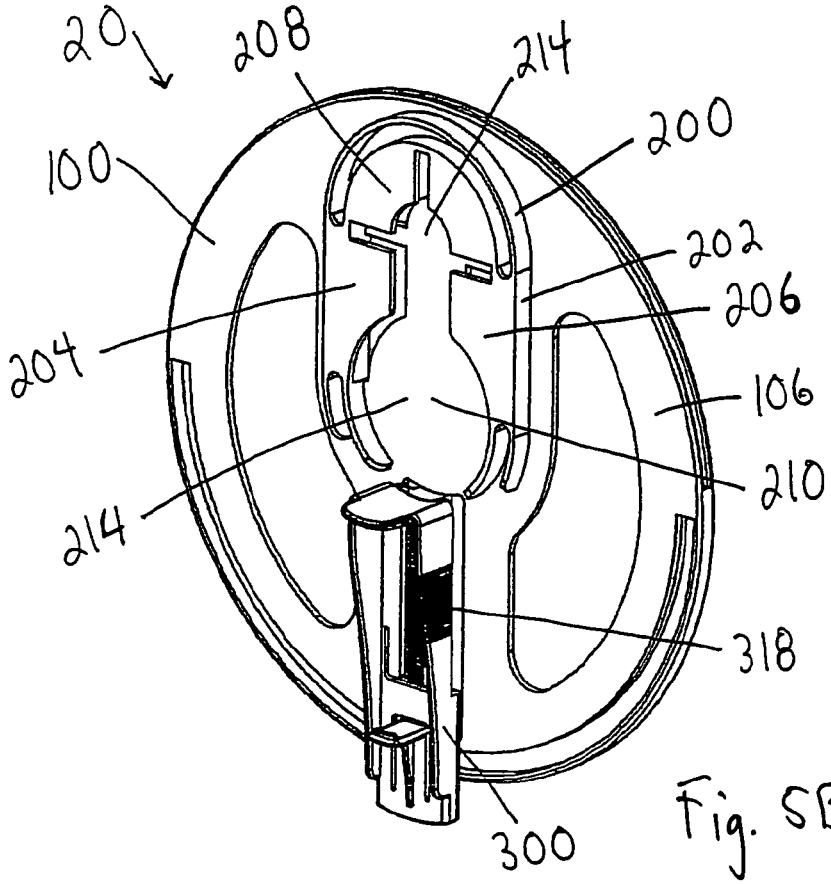
FIG. 5B is rear perspective view of the end cap of FIG. 5A.
Figure 6A:
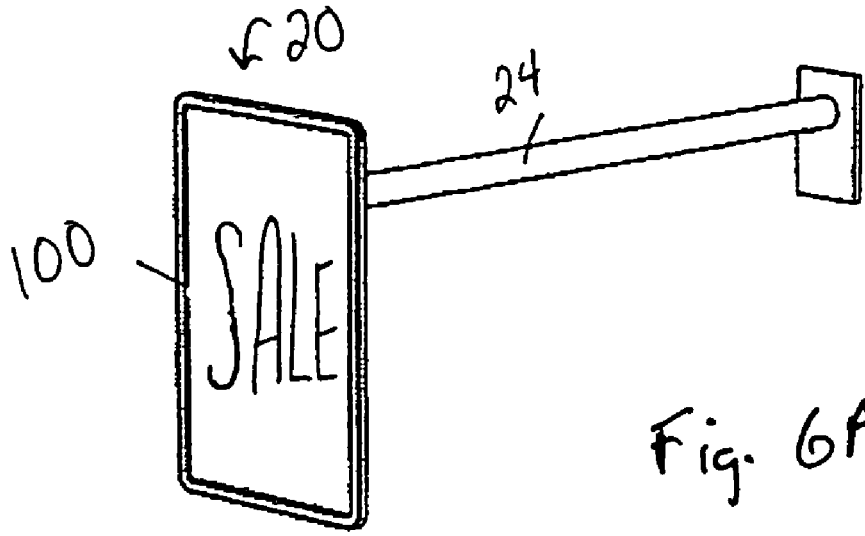
FIGS. 6A through 6D are front perspective views of other embodiments of the universal end cap.
Figure 6B:
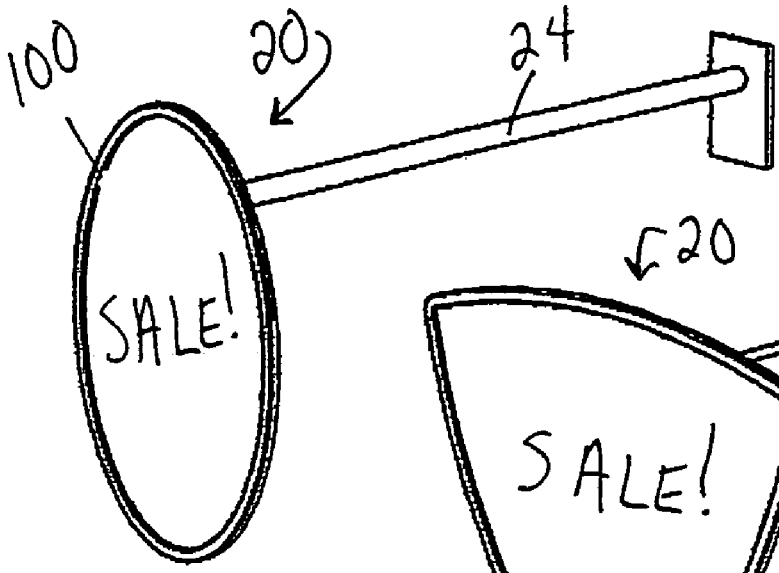
Figure 6C:
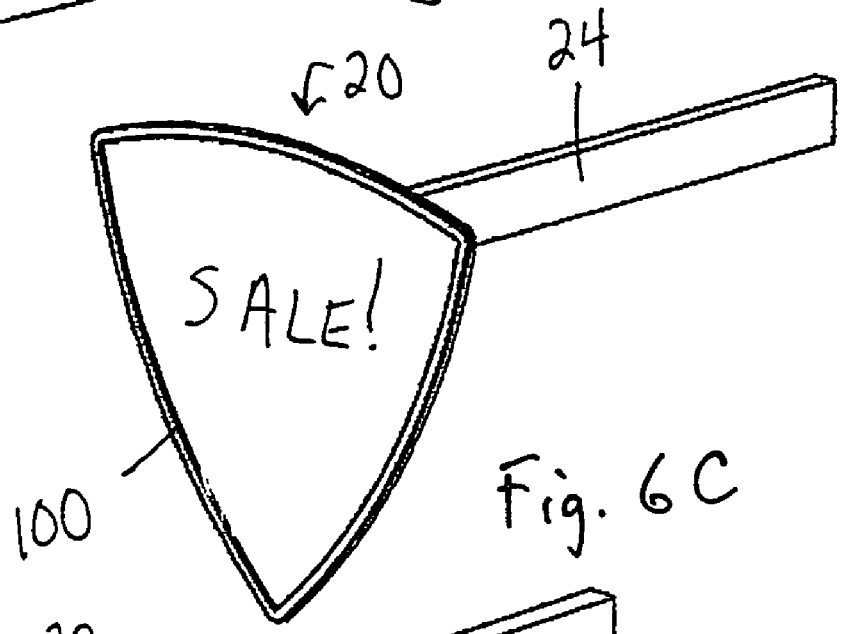
Figure 6D:
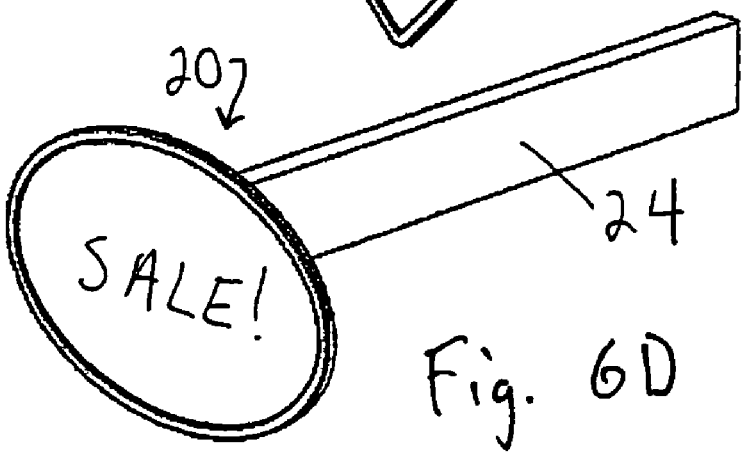

FIGS. 5A and 5B are perspective views of the front and back, respectively, of end cap 20. End cap 20 has a frame 100, an attachment section 200, and, preferably, a ratchet section 300. All components are preferably made of injection-molded plastic.

Frame 100 has a planar base 102 having a front side 104, a rear side 106, a periphery 108, and a lip 110 extending perpendicularly from the front side 104 of base 102 at periphery 108. Base 102 preferably has arcuate openings 112*a*, 112*b* to save weight and material costs. In the preferred embodiment, frame 100 is circular, as shown in FIGS. 2 through 5B, but it can be rectangular, oval, or triangular, as illustrated in FIGS. 6A through 6D, or any other shape.

Lip 110 extends completely around periphery 108 and has a shoulder 114 extending inwardly. The front side 104 of base 102, lip 110, and shoulder 114 thereby define a channel 116, having an interior width slightly greater than the thickness of the collateral 22. A slot 118 is situated in lip 110 and extends approximately halfway around the periphery 108 of base 102. Collateral 22 can be inserted in slot 118, as shown in FIG. 3, and rests in place in channel 116, held in place by lip 110 and shoulder 114, as shown in FIG. 4.

In another embodiment, lip 110 and shoulder 114 extend only halfway around the periphery of base 102. Collateral 22 is inserted into channel 116 and is held in place by lip 110 and shoulder 114.

In an embodiment in which frame 100 is round, a key 120 is preferably placed in channel 116 opposite slot 118. A corresponding notch 32 in collateral 22, as shown in FIG. 2, receives key 120, to keep collateral 22 oriented in a proper direction within frame 100. (Key 120 is not necessary for oval, square, rectangular, or triangular embodiments of frame 100.)

Figure 7A:
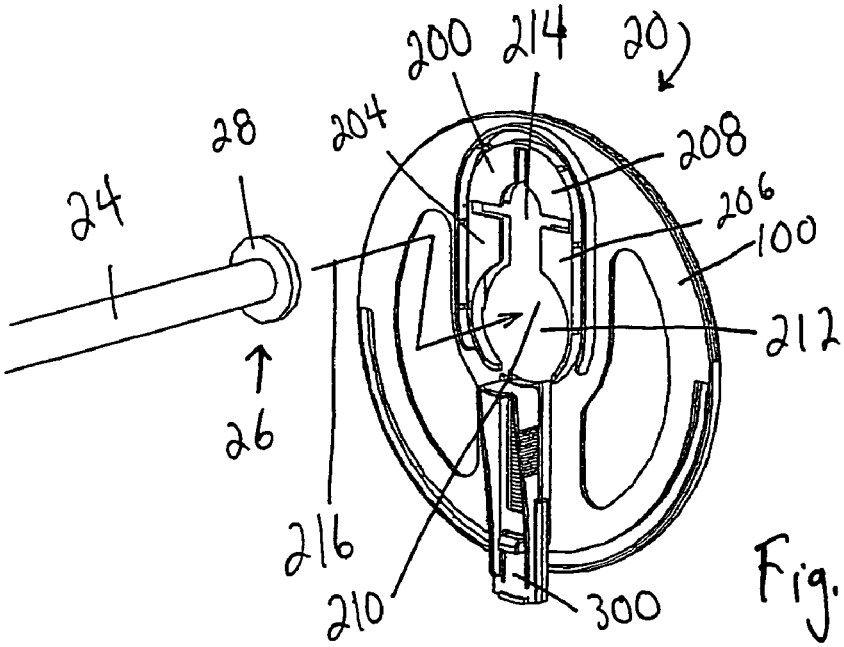
FIG. 7A is a perspective view of the method of attachment of the end cap of FIG. 5A to a fixture arm.
Figure 7B:
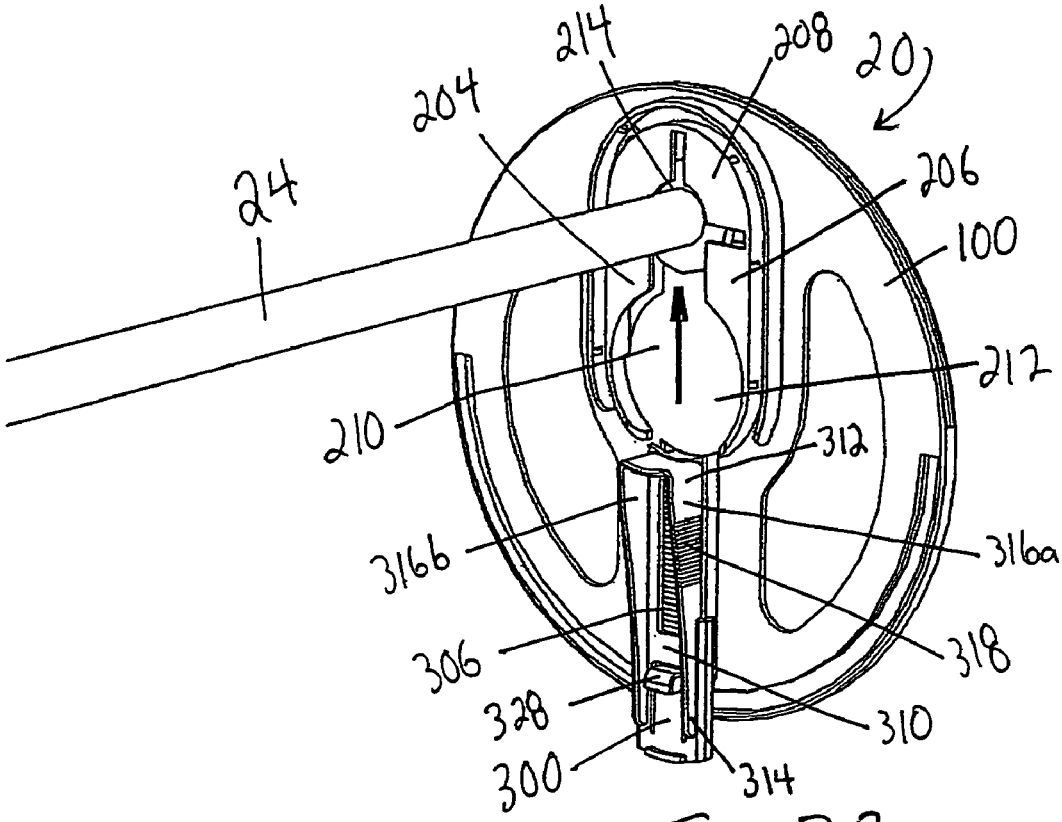
FIG. 7B is a perspective view of the end cap and fixture arm of FIG. 7A, with the end cap mounted but not locked.

Attachment section 200 is shown in perspective views in FIGS. 5B, 7A, and 7B. Attachment section 200 is coupled to frame 100, preferably by molding attachment section integrally with frame 100, or by gluing, welding, screwing, bolting, riveting, or otherwise fastening attachment section 200 to the rear 106 of base 102 of frame 100.

Attachment section 200 consists of framework 202, jaws 204, 206, and head 208. Framework 202 is a generally U-shaped wall extending perpendicularly from rear side 106 of base 102. Jaws 204, 206 are tapered flanges projecting inwardly from each side of framework 202. Head 208 is an arched flange projecting inwardly from the upper portion of framework 202. Head 208 and jaws 204, 206 thereby define a key-shaped aperture 210 having a lower slot 212 and an upper slot 214, whereby lower slot 212 is larger than upper slot 214.

Attachment section 200 of end cap 20 is secured to an end cap key 26 of a fixture arm 24. (Merchandise, such as clothing, is displayed on hangers, which hang from arm 24.) End cap key 26 has, for example, rib 28 extending from the end of fixture arm 24 opposites the end attaching to a wall or fixture trunk. Rib 28 is inserted into slot 212 as shown by directional arrow 216 in FIG. 7A. End cap 20 is pushed downward (or falls by gravity) as shown in FIG. 7B, in which head 208 then holds rib 28, with arm 24 extending out of slot 214. By this arrangement, a single design of end cap 20 can fit over a variety of end cap keys 26, such as the ones illustrated in FIG. 5.

Figure 7C:
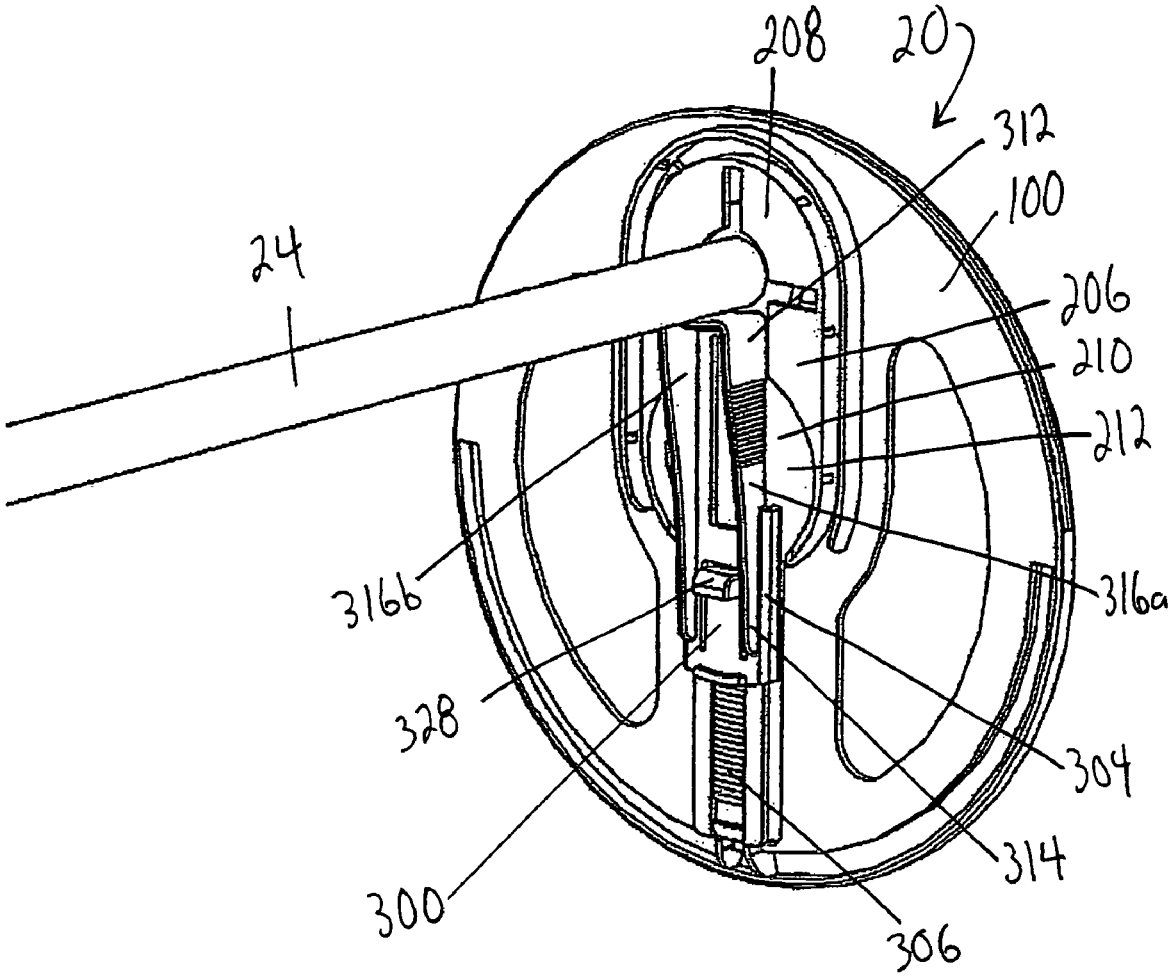
FIG. 7C is a perspective view of the end cap and fixture arm of FIG. 7A, with the end cap mounted and locked.

End cap 20, having a frame 100 and attachment section 200, as hereinabove described, will stay on a fixture arm 24 by gravity. In the preferred embodiment, however, end cap 20 is further secured to end cap key 26 by ratchet section 300, as shown in FIG. 7C.

Figure 8A:
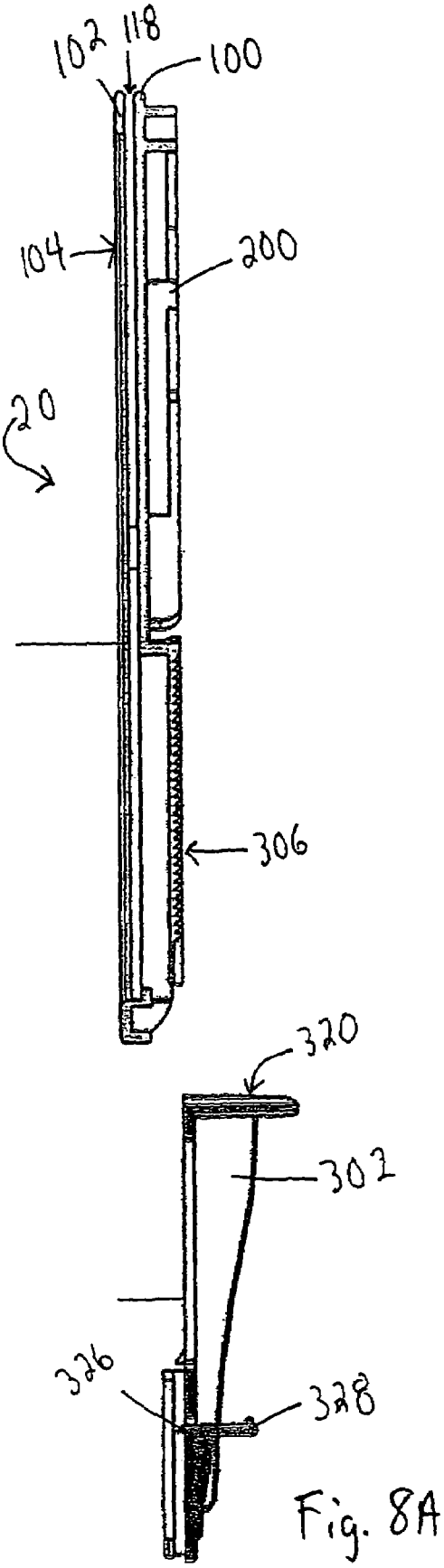
FIG. 8A is a side cross-sectional view of the frame and unattached framework of the preferred embodiment of the present invention.
Figure 8B:
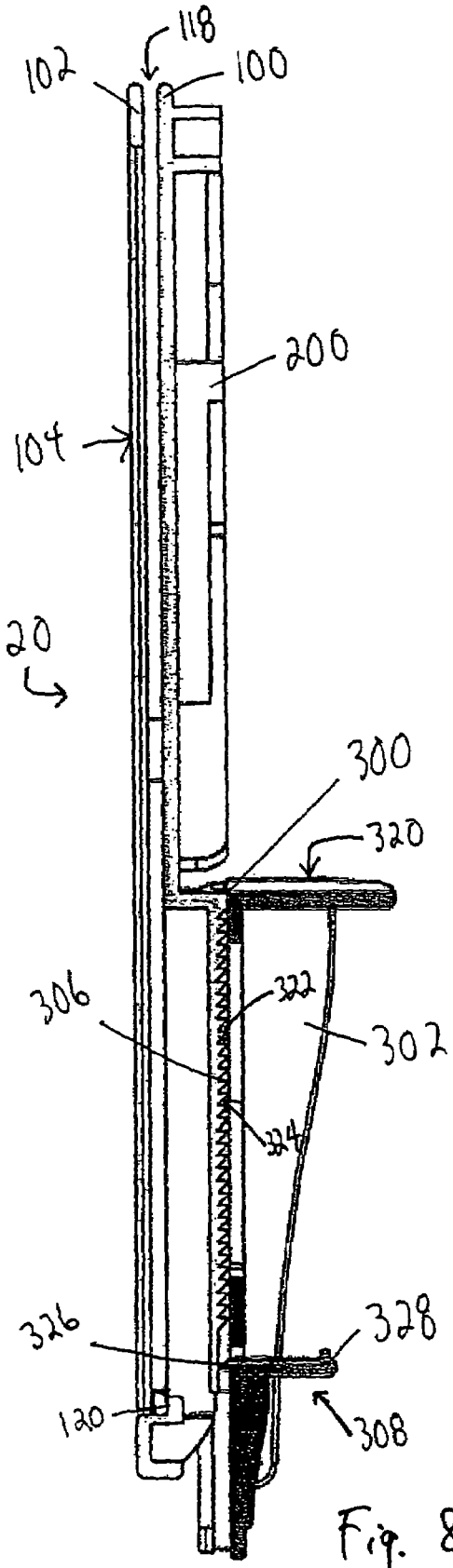
FIG. 8B is a side cross-sectional view of the frame and attached framework of the preferred embodiment of the present invention.
Figure 11A:
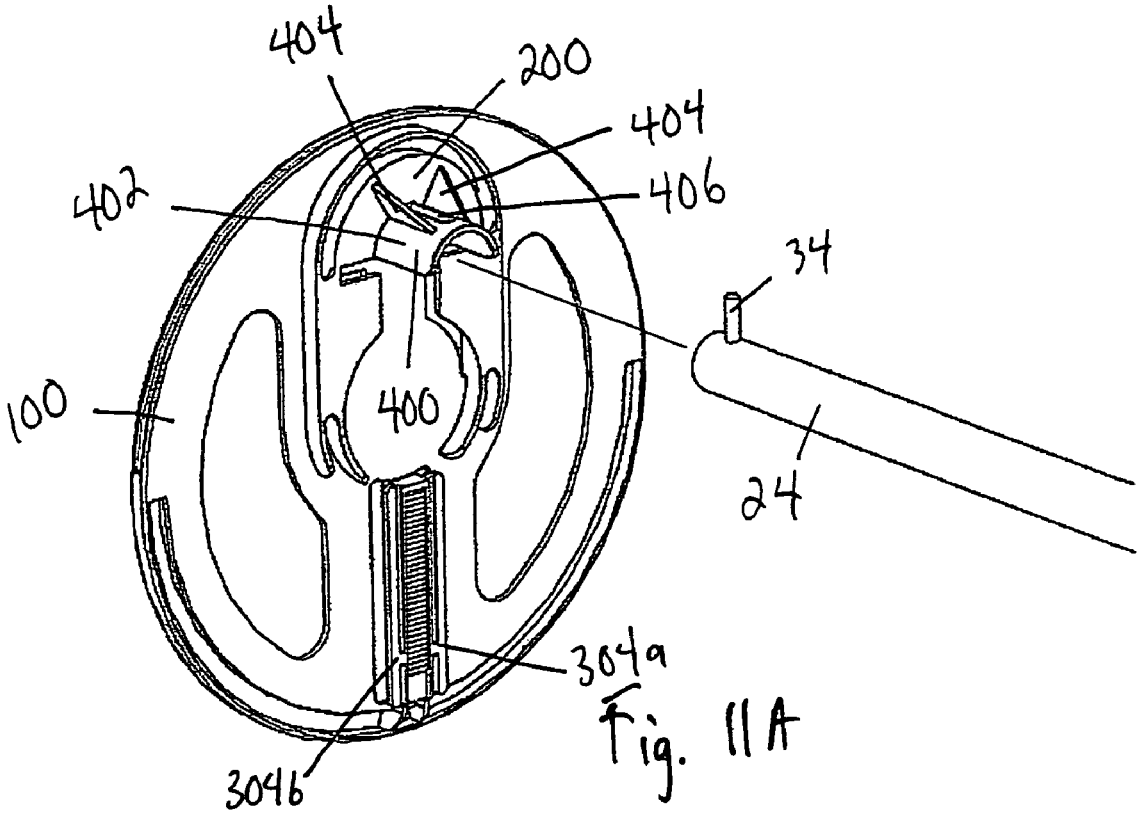
FIG. 11A a perspective view of another embodiment of the end cap of the present invention and a fixture arm.
Figure 11B:
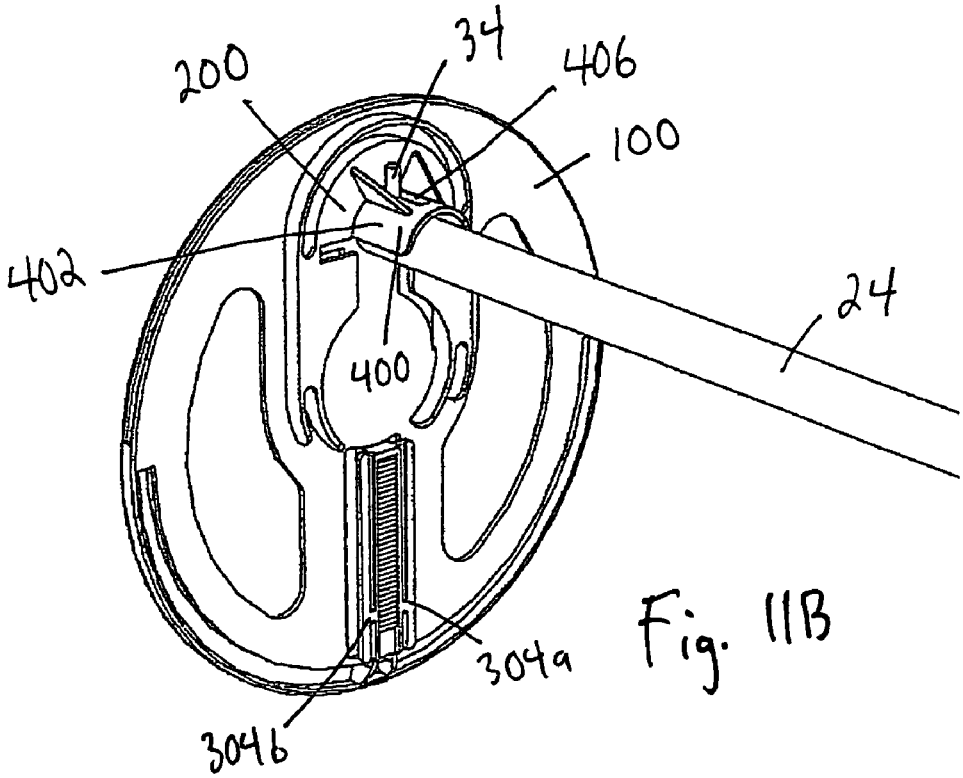
FIG. 11B a perspective view of the end cap of FIG. 11A attached to the fixture arm.

Ratchet section 300, shown in cross-sectional views as unattached to frame 100 in FIG. 8A and as attached to frame 100 in FIG. 8B, has a framework 302 that slides within guides 304*a*, 304*b*, which are shown in, for example, FIGS. 11A and 11B. Teeth 306 are arranged between guides 304*a*, 304*b*, and engage locking latch 308, which are part of framework 302.

Framework 302 is an element separately manufactured from frame 100. Framework 302 has a base section 310 having a first end 312 and a second end 314. Two gripping walls 316*a*, 316*b* extend perpendicularly from base section 310 and taper from first end 312 to second end 314. Gripping walls 316*a*, 316*b* preferably have ribs 318 molded therein for increased friction between gripping walls 316*a*, 316*b* and a user's fingers. Support face 320 extends perpendicularly from second end 314 and joins the upward tapered gripping walls 316*a*, 316*b*.

Guides 304*a*, 304*b* are L-shaped projections from rear 106 of base 102 and are preferably molded integrally with frame 100. Guides 304*a*, 304*b* extend parallel to each other from periphery 108 to lower slot 212. Teeth 306 are serrations in the surface of rear 106 of base 102, run perpendicular to and between guides 304*a*, 304*b* and are preferably molded integrally with frame 100. Each tooth 306 has a face 322 perpendicular to the plane of base 102 on a side proximal to upper slot 214, and a face 324 slanted in relation to the plane of base 102 on a side distal to upper slot 214.

Figure 9:
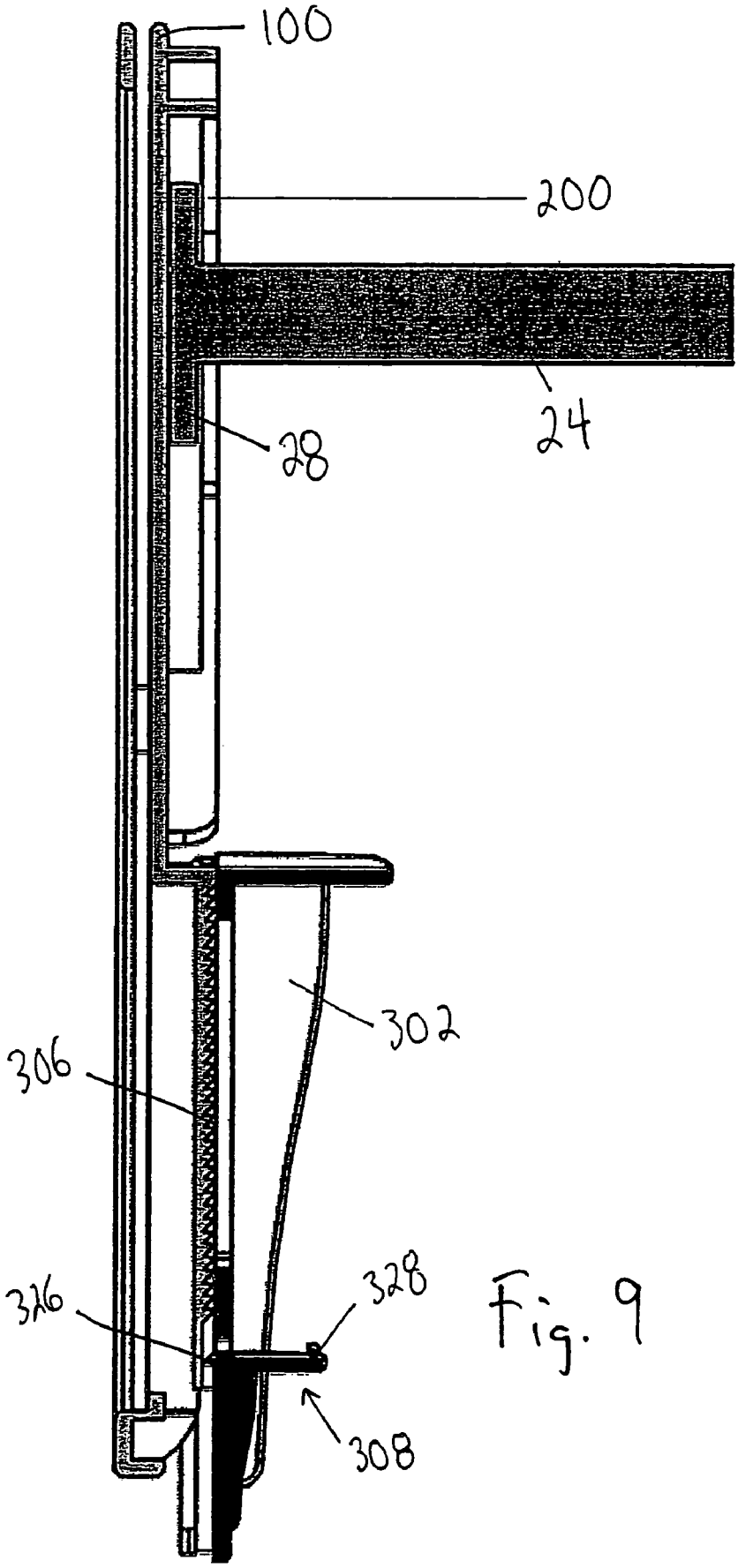
FIG. 9 is a side cross-sectional view of the end cap of the preferred embodiment of the present invention, with the framework in its first position.

Locking latch 308 is a tongue formed within base section 310 near second end 314. Latch 308 has a downwardly projecting finger 326 and an upwardly projecting tab 328. Framework 302 slides between guides 304*a*, 304*b*, from a first position remote from upper slot 214 to a second position adjacent to upper slot 214. FIG. 9 is a cross-sectional view of framework 302 in its first position, with a fixture arm 24 engaged in attachment section 200. FIG. 7C is a perspective view of framework 302 in its second position.

As framework 302 moves from its first position to its second position, finger 326 will slide over slanted face 324 of each tooth 306. Latch 308 is biased in a direction towards teeth 306, so that finger 326 will insert itself into the space between a particular tooth 306 and the next tooth 306. When framework 302 is placed by a user in a desired position, finger 326 will engage a perpendicular face 322 of a tooth 306 and will remain securely in that position until a user lifts locking latch 308 by using tab 328. A user, by lifting tab 328, can slide framework 302 back to its first position.

Accordingly, a user initially places framework 302 in its first position, and then inserts rib 28 into lower slot 212, as shown in, for example, FIG. 7A. End cap 20 is then pushed down so that arm 24 is engaged within upper slot 214 and rib 28 is beneath head 208. The user then grips ribs 318 and slides framework 302 towards its second position, until support face 320 engages fixture arm 24. When the user releases framework 302, it will remain in that position, locked by the engagement of finger 326 with a tooth 306, thereby securing end cap 20 to arm 24. Collateral can then be placed within frame 100 to draw shoppers' attention to the merchandise hung on arm 24.

Figure 10C:
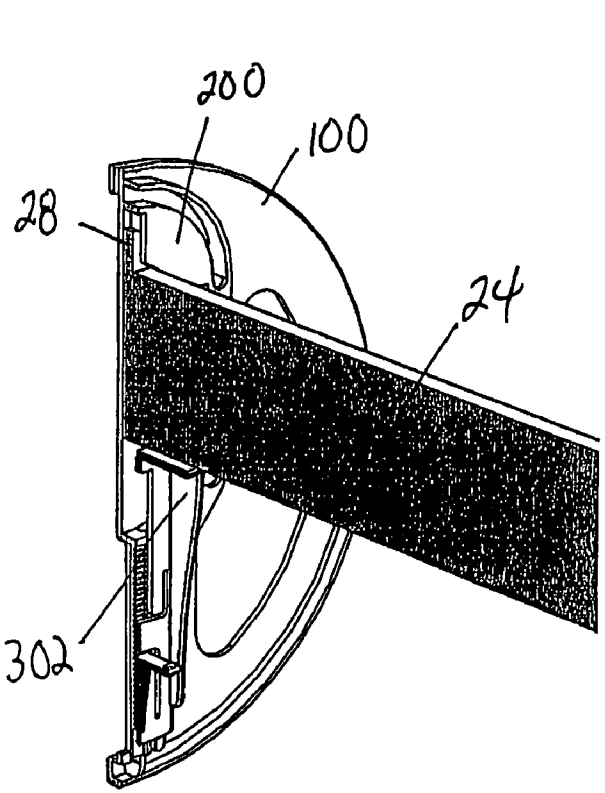
FIG. 10C a perspective view of the end cap of the preferred embodiment of the present invention, with the framework in its second position holding a large-diameter fixture arm.
Figure 10B:
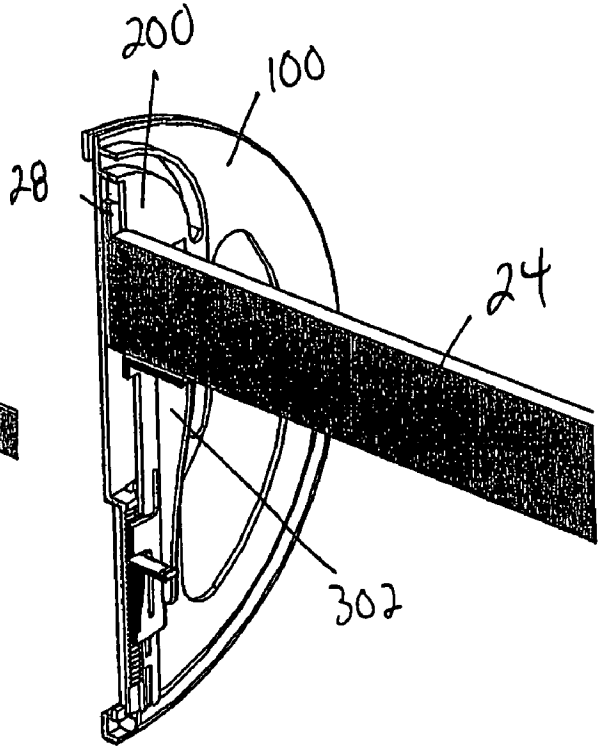
FIG. 10B a perspective view of the end cap of the preferred embodiment of the present invention, with the framework in its second position holding a medium-diameter fixture arm.
Figure 10A:
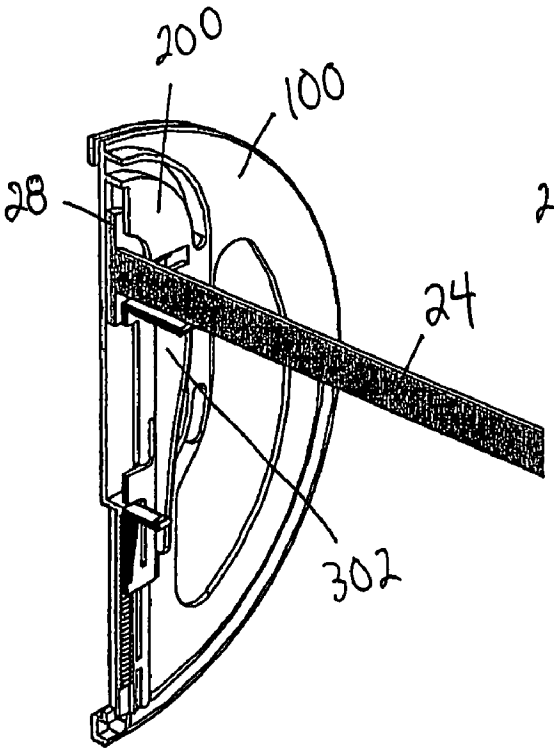
FIG. 10A a perspective view of the end cap of the preferred embodiment of the present invention, with the framework in its second position holding a small-diameter fixture arm.

Because ratchet section 300 is adjustable, end cap 20 can be used on a wide variety of sizes of fixture arms 24. FIGS. 10A, 10B, and 10C are partial cutaway views of framework 302 in its second position with a small diameter fixture arm, a medium-sized fixture arm, and a large fixture arm, respectively.

Figure 12A:
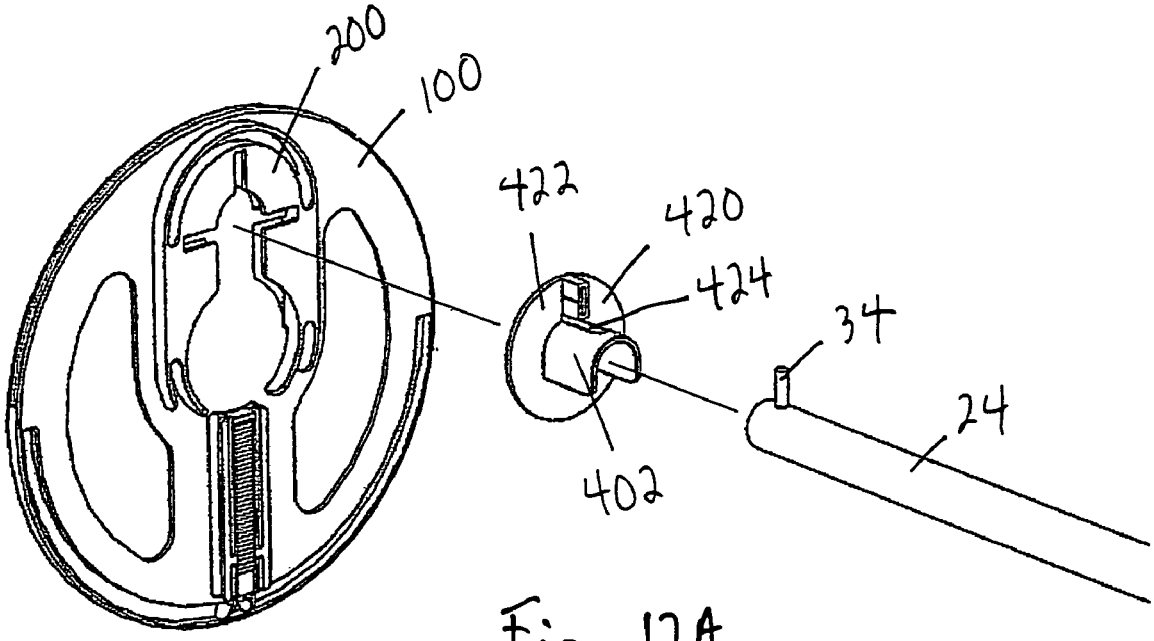
FIG. 12A a perspective view of yet another embodiment of the end cap of the present invention and a fixture arm.

In another embodiment, end cap 20 can accommodate additional profiles of fixture arms 24. For example, some fixture arms 24, rather than ending in an end cap key as previously described, have an end cap pin 34 projecting upwards, as shown in FIGS. 11A and 12A. Adapter 400, which can be a separate device or can be integral to end cap 20, can be used to secure end cap 20 to this type of fixture arm 24.

In a first embodiment, adapter 400, as shown in FIG. 11A, is a curved wall 402 projecting from head 208 of attachment section 200. Wall 402 can have one or more support ribs 404 between wall 202 and head 208 for added strength. A slot 406 in wall 402 receives pin 34. End cap 20, in this embodiment, can accommodate the end cap keys 26 shown in FIGS. 1A and 1B, or can accommodate the alternative design of fixture arm, as shown in FIG. 11B.

Figure 12B:
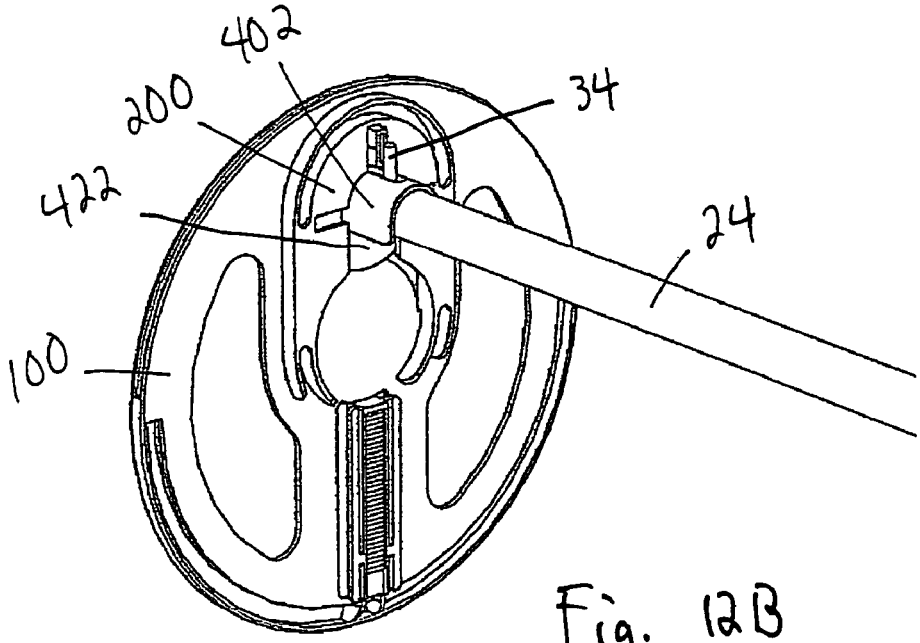
FIG. 12B a perspective view of the end cap of FIG. 12A attached to the fixture arm.

In another embodiment, adapter 420 is a separate device, as shown in FIG. 12A. Circular platform 422 has a curved wall 402 projecting therefrom, with a slot 424 to receive pin 34. End cap 20, in this embodiment, can accommodate the end cap keys 26 shown in FIGS. 1A and 1B, or can accommodate the alternative design of fixture arm, as shown in FIG. 12B.

While preferred embodiments of the present invention are shown and described, it is envisioned that those skilled in the art may devise various modifications of the present invention without departing from the spirit and scope of the appended claims.

We claim:

1. An end cap for mounting on a fixture arm for displaying collateral, comprising:

a frame, an attachment section coupled to said frame and comprising a keyhole slot, whereby an end cap key of the fixture arm engages said keyhole slot; and a ratchet to secure said attachment section to the end cap key.

2. An end cap for mounting on a fixture arm for displaying collateral, the fixture arm having an end cap key, said end can comprising:

a frame;

an attachment section coupled to said frame and comprising a keyhole slot, the end cap key engaging said keyhole slot;

a framework securing said attachment section to the end cap key, said framework mounted within guides on said frame, said framework comprising a securing face and a finger; and teeth located on said frame between said guides, said teeth engaging said finger to lock said framework in a desired position.

3. The end cap of claim 2, further comprising a latch holding said finger.

4. The end cap of claim 3, further comprising a tab mounted to said latch.

5. An end cap for mounting on a fixture arm for displaying collateral, comprising:

a frame comprising a base, a lip protruding from said base, a channel in said lip, and a slot in said lip, whereby the collateral fits through said slot and is engaged by said channel;

an attachment section coupled to said frame and comprising a wall projecting from said frame and a head section and a pair of jaw sections protruding inwards from said wall, said head section and said jaw sections defining a keyhole slot comprising a first slot defined by said jaw sections and a second slot defined by said head section and said jaw sections; and a ratchet securing an end cap key of the fixture arm within said keyhole slot said ratchet comprising a framework mounted within guides on said frame, said framework comprising a securing face, a latch, a finger mounted to said latch and protruding from said latch in a direction toward said frame, and a tab mounted to said latch and protruding from said latch in a direction away from said frame, said latch biased to engage said finger in said teeth and said tab operable to disengage said finger from said teeth.

* * * * *